US005437380A

United States Patent [19]

Peay et al.

[11] Patent Number: 5,437,380

[45] Date of Patent: Aug. 1, 1995

[54] SYSTEM FOR DIVIDING A WIRE DECK

[75] Inventors: Thomas H. Peay, Antioch; Donald E. Schrader, Nashville, both of Tenn.

[73] Assignee: Nashville Wire Products Co., Nashville, Tenn.

[21] Appl. No.: 302,243

[22] Filed: Sep. 8, 1994

Related U.S. Application Data

[63] Continuation of Ser. No. 14,194, Feb. 5, 1993, abandoned.

[51] Int. Cl.[6] ..... A47F 5/00

[52] U.S. Cl. ..... 211/184; 108/61; 211/181

[58] Field of Search ..... 211/181, 184, 43; 108/61

[56] References Cited

U.S. PATENT DOCUMENTS

| | | | |
|---|---|---|---|
| 3,358,956 | 12/1967 | Thornton | 211/184 X |
| 3,703,964 | 11/1972 | Field | 211/184 |
| 3,739,918 | 6/1973 | Kreitzburg | 211/184 X |
| 3,877,580 | 4/1975 | Hammar | 211/184 |
| 4,023,682 | 5/1977 | Niece | 211/184 |
| 4,693,382 | 9/1987 | Galen | 211/184 X |
| 4,729,485 | 3/1988 | Kulbersh | 211/184 |
| 5,082,125 | 1/1992 | Ninni | 211/184 |
| 5,148,927 | 9/1992 | Gebka | 211/184 |

*Primary Examiner*—Robert W. Gibson, Jr.
*Attorney, Agent, or Firm*—Waddey & Patterson; Edward D. Lanquist, Jr.

[57] ABSTRACT

A system for dividing a wire deck is provided. The system has a divider which is attached to opposed clips. These clips attach, releasibly, to the wire of the deck. These hooks can attach to either the longitudinal wires or the latitudinal wires. The divider is surrounded by a perimeter member which is continuous except for a space between the opposes clips. The upper side of the perimeter member is made of resilient material which allows the upper side to flex thereby creating a biasing means between the opposed hooks.

3 Claims, 2 Drawing Sheets

SYSTEM FOR DIVIDING A WIRE DECK

This application is a continuation of application Ser. No. 08/014,194, filed Feb. 5, 1993, now abandoned.

BACKGROUND OF THE INVENTION

The present invention relates generally to a device for dividing a wire deck and more particularly to a device attachable to a wire deck extending vertically from the wire deck which can divide the deck into sections.

It will be appreciated by those skilled in the art that many companies use wire deck in place of flooring or shelving. This wire deck is much less expensive and easier to maintain than sheet decking. It will be further appreciated by those skilled in the art that often these companies desire to segment the decking into horizontal sections for storage. To this end, there have been several attempts to provide such dividers.

Presently, companies are horizontally dividing decked areas by hanging a divider from above. These dividers are often hung from pipes or from the deck which is immediately above the deck to be divided. Unfortunately, these dividers are difficult to use. Further, most of the force in the storage area is being directed to the portion of the divider which is farthest away from its support member thereby causing a severe moment arm which causes severe stress and strains on the attachment point.

What is needed, then, is a system for dividing a wire deck. This system must be capable of attachment to the wire deck to be divided. This system must be releasibly attached to the deck to be divided. This system must be attachable to either the latitudinal or longitudinal wires. This system must be easy to manufacture and inexpensive to produce. This system is presently lacking in the prior art.

SUMMARY OF THE INVENTION

In the present invention, a system for dividing a wire deck is provided. The system has a divider which is attached to opposed clips. These clips attach, releasibly, to the wire of the deck. These hooks can attach to either the longitudinal wires or the latitudinal wires. The divider is surrounded by a perimeter member which is continuous except for a space between the opposes clips. The upper side of the perimeter member is made of resilient material which lo allows the upper side to flex thereby creating a biasing means between the opposed hooks.

Accordingly, an object of the present invention is to provide a system for dividing a wire deck.

Still a further object of the present invention is to provide a system which can be releasibly attached to a wire deck.

Still a further object of the present invention is to provide a system which is attachable to the deck to be divided.

A Still further object of the present invention is to provide a system which is releasibly attachable to the deck to be divided.

Still a further object of the present invention is to provide s system which is easy to manufacture and inexpensive to produce.

DESCRIPTION OF THE PREFERRED EMBODIMENT

Figure 1:
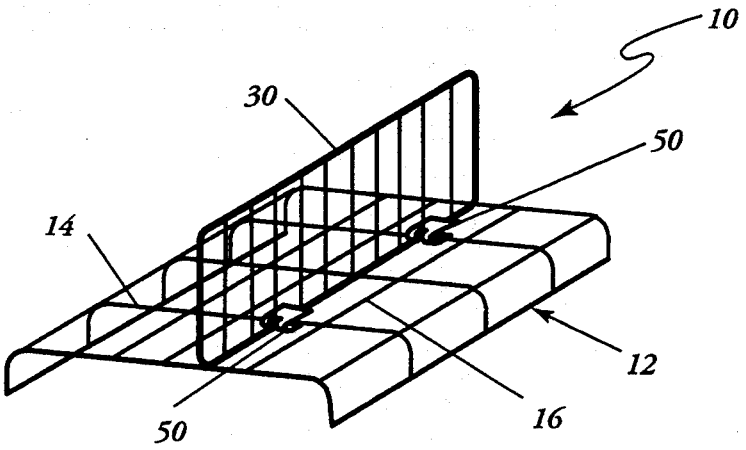
FIG. 1 is a perspective view of the system for dividing a wire deck of the present invention.

Referring now to FIG. 1 there is shown generally at 10 the system for dividing a wire deck of the present invention. FIG. 1 shows that system 10 has divider 30 and opposed clips 50. System 10 attaches to wire deck 12 which has longitudinal wires 14 and latitudinal wires 16. Opposed clips 50 can either attach to longitudinal wires 14 as shown in FIG. 1 or they can attach to latitudinal wires 16.

Figure 2:
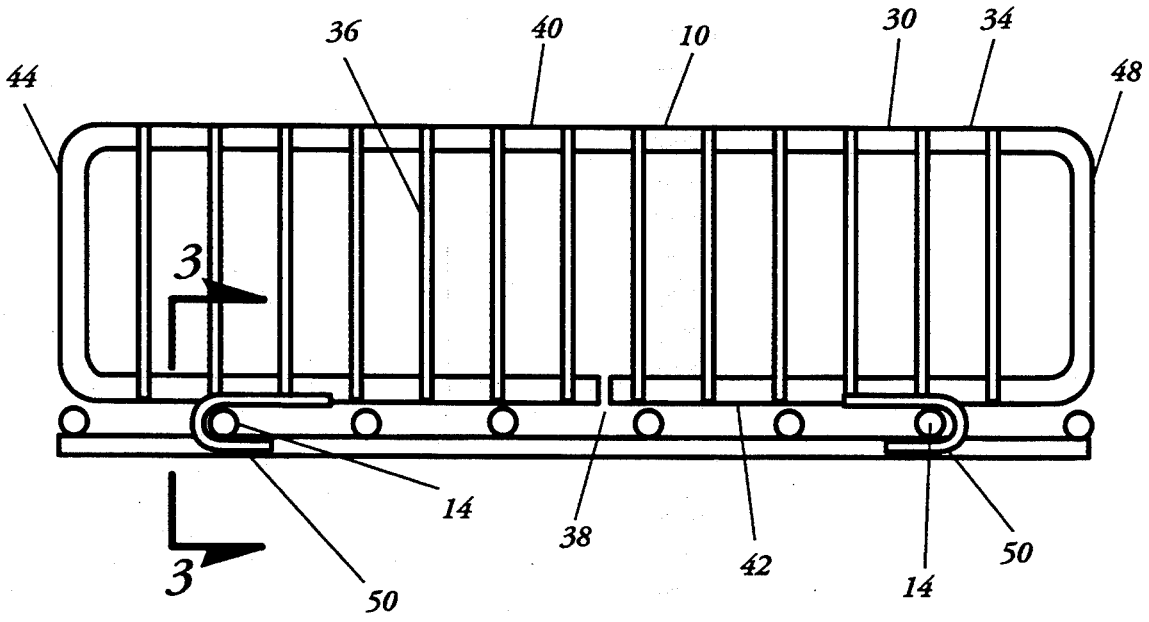
FIG. 2 is a frontal view of the system of the present invention.

Referring now to FIG. 2, system 10 is more clearly shown. System 10 has divider 30 which is attached to opposing clips 50. Divider 30 has perimeter member 34 which surrounds divider 30 except at space 38. Divider 30 has upper side 40, lower side 42, first end 44, and second end 48. In between, and substantially parallel to, first end 44 and second end 46 are vertical support members 36. Perimeter member 34 is made of some type of resilient or elastic material such that divider 30 at upper side 40 can act as a biasing means to bias opposing clips 50 to allow releasable attachment of clips 50 to wires 14.

Figure 3:
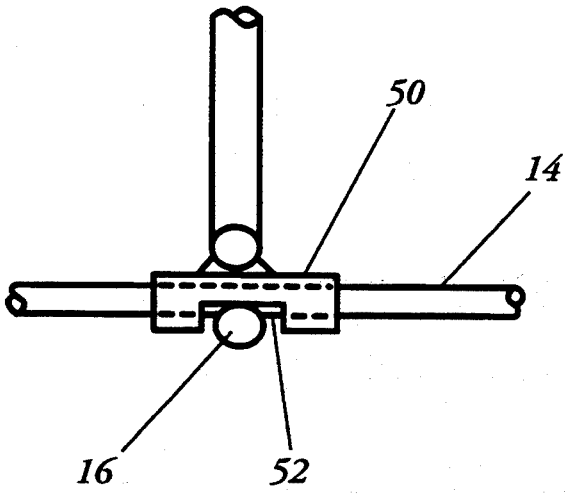
FIG. 3 is a side cut-away view along A—A of FIG. 2.
Figure 4:
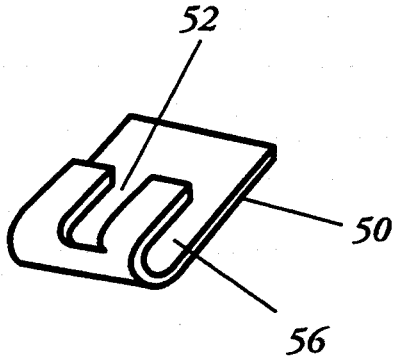
FIG. 4 is a perspective view of the clip of the present invention.

Referring now to FIGS. 3 and 4 there is shown generally how clip 50 works. Clip 50 has slot 52 and hooks 56. When hook 56 of clip 50 is placed over, for example, a longitudinal wire 14, slot 52 receives latitudinal wire 16. Conversely, if hook 56 of clip 50 receives latitudinal wire 16, slot 52 longitudinal wire 14.

Figure 5:
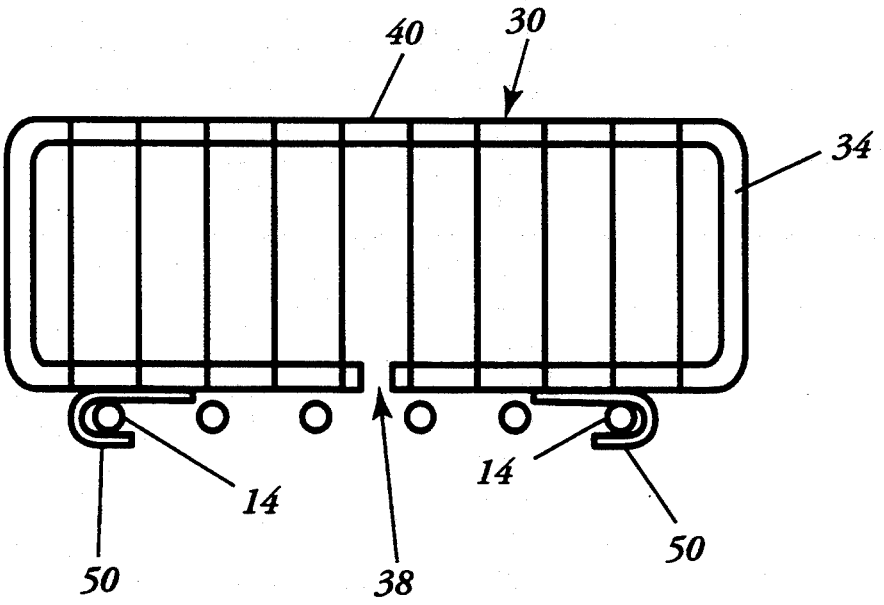
FIG. 5 is a frontal view of the system of the present invention.

As can be seen in FIG. 5, divider 30 having perimeter member 34 proximate to upper side 30 which is resilient, allows, in connection with space 38 for opposed clips 50 to bias together and apart thereby allowing releasable attachment to wires 14. Lower side 42 comprises first section 80 and second section 82 which are adjacent to one another but are not joined as they are separated by space 38.

The distance between opposed clips 50 can vary because of the variance in distance between wires. In the preferred embodiment, system 10 is made of low carbon cold drawn steel. However, a highly resilient plastic can be used. Further, perimeter member 34, instead of being substantially continuous, can be segmented and attached to corners. It is only important that perimeter member 34 proximate to upper side 30 be made of some type of elastic material and that space 38 be placed between opposing clips 50.

Thus, although there have been described particular embodiments of the present invention of a new and useful system for dividing wire deck, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What we claim is:

1. A device attachable to a wire deck having longitudinal and latitudinal wires, said device comprising:

a. a divider having a perimeter member which surrounds said divider except at a space and having an upper side and a lower side wherein said space making said perimeter member uncontinuous along said lower side;

b. a pair of opposed, spaced-apart clips attached to said lower side of said perimeter member of said divider;

c. said upper side of said perimeter member for biasing said clips releasibly attachable to either said longitudinal or said latitudinal wires;

d. plural vertical support members joining said upper side and said lower side; and e. said divider, said clips, and said plural support members unitarily constructed so as to allow attachment to said wires without separation.

2. A device, attachable to a wire deck having longitudinal wires and latitudinal wires, said device extending substantially upwardly from said deck, said device comprising:

a. a divider having a perimeter member which surrounds said divider except at a space and having an upper side, a first end, a second end, and a lower side wherein said space making said perimeter member uncontinuous along said lower side, wherein said upper side being the sole continuous horizontal member;

b. a pair of opposed, spaced-apart clips attached to said lower side of said divider such that said clips releasible attachable to any pair of said latitudinal wires or said longitudinal wires without releasing said clips from said lower side;

c. means attached to said divider for biasing said clips comprising a said horizontal member; and d. plural vertical supports joining said upper side and said lower side.

3. A device, releasible attachable to a wire deck having longitudinal wires and latitudinal wires, extending substantially upwardly from said deck, said device comprising:

a. a divider having an upper side and a lower side joined by a first end and a second end, said lower side having a first section adjacent but not joined with a second section, said divider having an outer edge, said outer edge having a perimeter member continuous except at a space on said lower side wherein said space making said perimeter member uncontinuous along said lower side, said lower side being discontinuous at said space;

b. a pair of opposed, spaced-apart clips attached to said lower side of said divider such that said clips being releasible attachable to either said longitudinal wires or latitudinal wires without separating said clips from said lower side, each of said clips having a hook, each of said hooks having a slot, said hooks of said clips being opposed;

c. said space placed between said clips; and d. said perimeter member proximate said upper member biasing said clips, wherein said upper side being the sole continuous horizontal member.

* * * * *